United States Patent [19]

De Santis

[11] 4,377,376

[45] Mar. 22, 1983

[54] INDEXING MECHANISM FOR THE ANVIL ASSEMBLY OF A POWDER-COMPACTING PRESS

[75] Inventor: Raymond P. De Santis, Troy, Mich.

[73] Assignee: PTX-Pentronix, Inc., Lincoln Park, Mich.

[21] Appl. No.: 305,127

[22] Filed: Sep. 24, 1981

[51] Int. Cl.[3] ..... B30B 11/02

[52] U.S. Cl. ..... 425/78; 425/355; 425/410; 425/357; 264/39

[58] Field of Search ..... 425/78, 214, 352, 355, 425/410, 357

[56] References Cited

U.S. PATENT DOCUMENTS

| | | | |
|---|---|---|---|
| 3,328,840 | 7/1967 | Vinsou | 425/78 |
| 3,344,213 | 9/1967 | Vinson | 264/39 |
| 3,561,054 | 2/1971 | Smith | 425/78 |
| 3,561,056 | 2/1971 | Smith et al. | 425/78 |
| 3,574,892 | 4/1971 | Smith | 425/78 |
| 3,645,658 | 2/1972 | De Troyer | 425/78 |
| 3,726,622 | 4/1973 | De Troyer et al. | 425/78 |
| 3,730,659 | 5/1973 | Smith | 425/78 |
| 3,775,032 | 11/1973 | Smith et al. | 425/78 |
| 3,826,599 | 7/1974 | De Santis et al. | 425/78 |
| 4,047,864 | 9/1977 | De Santis | 425/78 |
| 4,061,452 | 12/1977 | De Santis | 425/78 |
| 4,061,453 | 12/1977 | De Santis | 425/78 |
| 4,230,653 | 10/1980 | De Santis | 764/39 |

*Primary Examiner*—J. Howard Flint, Jr.
*Attorney, Agent, or Firm*—Hauke & Patalidis

[57] ABSTRACT

In an anvil powder compacting press, wherein the anvil, mounted on a work station positioner arcuately or longitudinally movable over a die plate in which is disposed a die cavity in which powder material is compacted between the face of a punch reciprocably disposed in the die cavity and the face of the anvil, is coarsely positioned over the die cavity by the work station positioner, an anvil indexing and locating mechanism for finely locating the anvil over the die cavity prior to compacting an article. The anvil fine indexing and locating mechanism is in the form of a plunger disposed in the anvil normally retracted and caused to project into a bore in the die plate. The locating plunger or pin is mechanically operated by the clamp clamping the anvil in position over the die cavity, or operated independently from the clamp.

8 Claims, 8 Drawing Figures

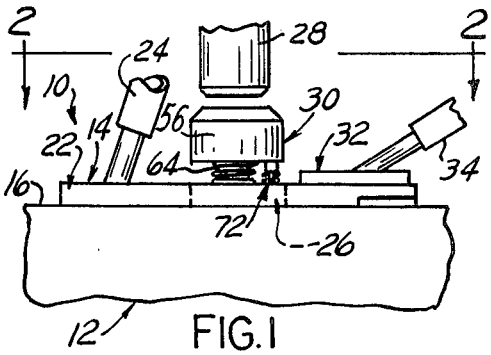
FIG.1
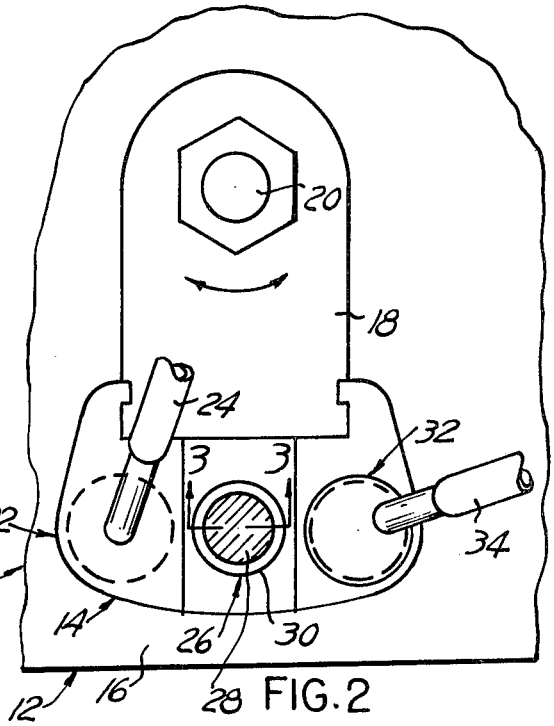
FIG.2
FIG.3
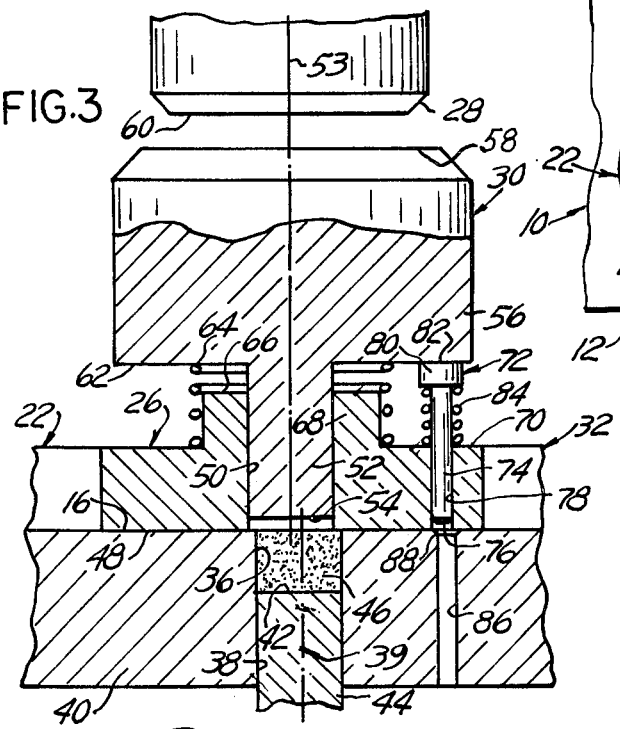
FIG.4
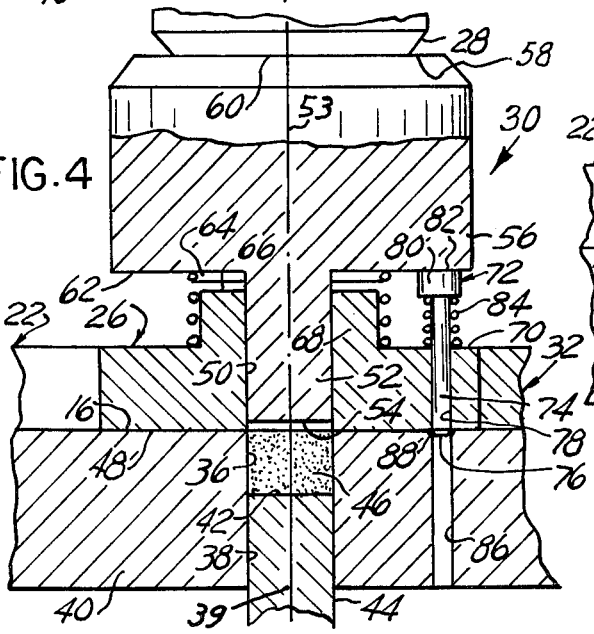
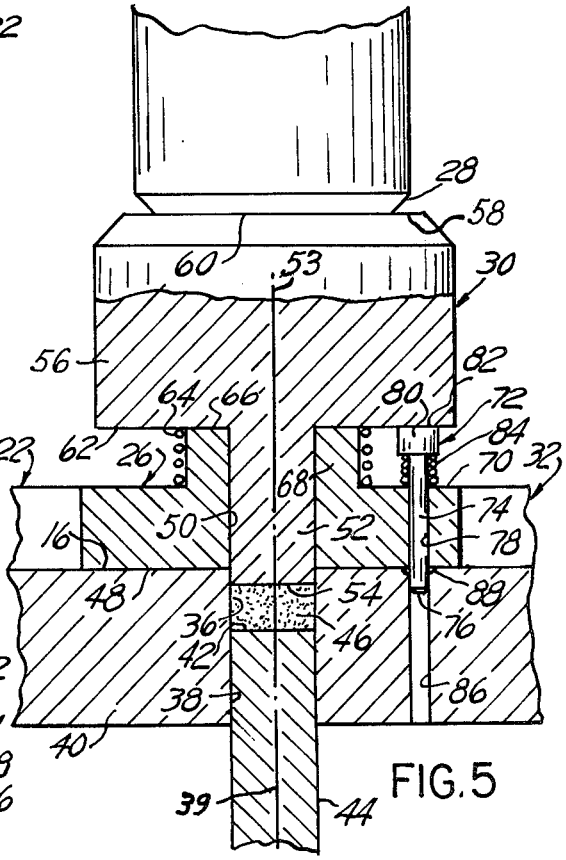
FIG.5

INDEXING MECHANISM FOR THE ANVIL ASSEMBLY OF A POWDER-COMPACTING PRESS

BACKGROUND OF THE INVENTION

The present invention relates to powder compacting apparatus and, more particularly, to an apparatus which produces a compacted article within very close dimensional tolerances in a die cavity between a reciprocable punch and a counterpunch or between a reciprocable punch and an anvil having a portion forming part of a molding cavity.

The present invention is concerned with improved tooling for use in powder-compacting presses such as are disclosed in U.S. Pat. Nos. 3,826,559; 3,775,032; 3,730,659; 3,726,622; 3,645,658; 3,574,892; 3,561,056; 3,415,412; 3,344,213; and 3,328,840, all of which are assigned to the same assignee as the present application.

In the powder-compacting presses disclosed in the aforementioned U.S. patents, articles are compacted and formed in a single or multi-cavity die forming part of a punch and die set, with the finished articles being automatically ejected from the die cavities, picked up by a vacuum pick-up head, and conveyed into suitable receptacles. A work station positioner assembly, which is part of the press, is mounted linearly or angularly movable transversely over the die plate and carries a powder dispenser, an anvil and a pick-up head. The powder dispenser, which is supplied with powder from primary powder supply means connected thereto by means of a flexible tubing or the like, is first positioned over the die cavity which is thus filled with powder as the punch is displaced downwardly so as to draw a predetermined amount of powder into the die cavity. The powder dispenser is then removed from above the die cavity by a subsequent angular or linear motion of the station positioner assembly, and the anvil is, in turn, positioned over the cavity. The anvil is clamped over the die cavity by means of a clamp supported above the anvil and actuated in timed relation with the movement of the punch. The anvil is held down with sufficient pressure to permit compaction of the powder against the anvil as a result of an upward motion of the punch into the die cavity. The anvil is then removed from its position over the die cavity and is replaced by the pick-up head, as a result of a further linear or angular motion of the work station positioner across the face of the die plate. The punch is displaced upwardly so as to bring its upper end in substantial flush alignment with the upper surface of the die plate, such that the finished compacted article is ejected from the die cavity and picked up by the pick-up head for transfer to an appropriate container.

In U.S. Pat. Nos. 3,775,032, 3,826,599, 4,047,864, 4,061,452, 4,061,453 and 4,230,653, also assigned to the same assignee as the present application, tooling arrangements for compacting articles from powder material are described in which a mold cavity is defined partly by the end face of an upper punch projecting through an anvil element above the die cavity, partly by the die bore wall and partly by the end face of the lower punch.

In U.S. application Ser. No. 300,577, filed on Sept. 8, 1981, there is disclosed a molding apparatus in the form of a die having a die cavity, and a punch reciprocably movable in the die cavity for compression powder material filling the die cavity by way of an upwardly directed stroke of the punch. The anvil face against which the powder material is compacted has a movable portion and a stationary portion such that the article is compacted with a portion of its upper face in engagement with the stationary portion of the anvil face and another portion in engagement with the movable portion of the anvil face.

In structures wherein, for example, an upper punch, or counterpunch, is disposed reciprocable in the anvil, or wherein a part of the molding cavity is formed by a portion of the anvil provided with a recess or with a movable section, in order to mold an article with high dimensional and shape accuracy, high precision is required in the making of the punches, counterpunches and anvil, and, in addition, the anvil must be precisely mounted on the work station positioner. The mechanism actuating the work station positioner, either arcuately or linearly, must be machined, assembled, and adjusted within close tolerance limts, in order to precisely align the working face of the anvil, or the counterpunch, with the die cavity. Even though high accuracy in components and assembly may be achieved when the powder compacting apparatus is manufactured, such high accuracy is costly to achieve and gradually deteriorates as a result of normal wear of the parts in motion. Gears develop backlash, and cam and slides are subjected to wear that results in play, lost motion, and gradual decrease in accuracy of the compacted articles, in dimension, in shape and in density. The problem of gradual wear and deterioration is further amplified when the powder material used for compacting articles is substantially abrasive, as is generally the case.

SUMMARY OF THE INVENTION

The present invention provides a coarse and fine indexing, locating and aligning mechanism for the anvil of an anvil powder compacting press, or for powder compacting presses having an upper punch, or counterpunch, disposed in a supporting and guiding block removable from over the die cavity during filling of the die cavity with powder material, and placed over the die cavity prior to compacting an article in the die cavity. The present invention accomplishes its object by providing a fine indexing, locating, and aligning mechanism in the form of a movable locating pin or plunger disposed in an appropriate bore in the anvil and mechanically, or otherwise, actuated for engagement in an appropriate bore in the die plate of a power compacting apparatus, the locating pin or plunger being normally retracted and caused to project into the die plate bore upon clamping the anvil over the die cavity. The fine indexing and locating step follows the coarse indexing and locating step effected by the work station positioner.

The diverse objects and advantages of the present invention will become apparent to those skilled in the art when the following description of examples of the best modes contemplated for practicing the invention is read in conjunction with the accompanying drawings wherein like numerals refer to like or equivalent parts and in which:

BRIEF DESCRIPTION OF THE DRAWINGS

FIG. 1 is a schematic partial front elevational view of a powder compacting apparatus incorporating the present invention;

FIG. 2 is a schematic partial top view from line 2—2 of FIG. 1;

FIG. 3 is a partial section from line 3—3 of FIG. 2;

FIGS. 4 and 5 are views similar to FIG. 3, and showing progressive steps in the operation of the present invention;

DETAILED DESCRIPTION OF THE PREFERRED EMBODIMENTS

Figure 6:
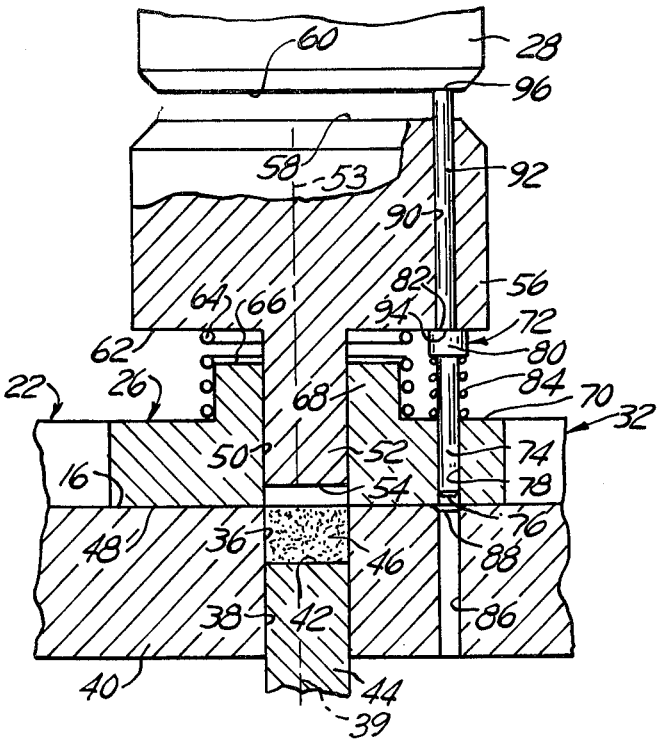
FIG. 6 is a view similar to FIG. 3, but showing a modification thereof.

Referring to the drawings and more particularly to FIGS. 1–2 thereof, there is schematically illustrated a portion of a powder compacting apparatus 10 helpful in providing to those skilled in the art an understanding of the present invention. The powder compacting press 10 has a table 12 having an opening, not shown, in which is mounted a die plate having a vertical bore defining a portion of a molding cavity in which is disposed a reciprocable punch, as is well known in the art. A work station positioner 14 is arcuately displaceable over the table 12 in sliding engagement with the table and die plate upper surface 16. In the example of structure illustrated, the work station positioner 14 is mounted on the end of a positioner arm 18, FIG. 2, arcuately driven by a drive shaft 20 whose oscillation motion around its longitudinal axis is provided by drive means, not shown, forming part of the drive mechanism of the power compacting apparatus 10, in appropriate timed relationship with reciprocation of the punch reciprocable in the die cavity.

The work station positioner 14 is, in the example of structure illustrated, in the form of a block having a powder material dispenser 22 connected by a flexible tubing 24 to a powder material container, not shown. When, as a result of an appropriate motion of the drive shaft 20 of the work station positioner 14, the powder dispenser 22 is placed over the die cavity, the die cavity is filled with powder material. Subsequent displacement of the work station positioner 14 places an anvil 26, also mounted in the work station positioner 14, over the die cavity, and an upward motion of the punch compacts the powder material in the die cavity against the face of the anvil 26, the anvil 26 being solidly clamped in position over the die cavity by means of a clamp 28 actuated by the drive mechanism of the powder compacting apparatus 10. In the example of structure illustrated, the anvil 26 carries a counterpunch 30 which is actuated by the clamp 28 simultaneously with clamping the anvil 26 in position over the die cavity.

After an article has been compacted in the die cavity, further motion of the work station positioner 14 places a pick-up head 32 over the die cavity, and the compacted article is ejected by further motion of the lower punch into the pick-up head 32 for transport to an appropriate container. Alternatively, the finished article may be sucked through a flexible conduit 34 connected to the pick-up head 32 for transport to a remote location.

FIGS. 1–2 represent the work station positioner 14 in position for coarse positioning of the anvil 26 above the die cavity, just prior to compacting an article in the die cavity. As shown in detail at FIG. 3, the die cavity, identified by numeral 36, is formed by the upper portion of a bore 38, having an axis 39, disposed in a die plate 40 above the end face 42 of a reciprocable punch 44. The die cavity 36 has been previously filled with powder material, as shown at 46, flush with the top surface 16 of the die plate 40.

The anvil 26 has a lower face 48 in sliding engagement with the upper face 16 of the die plate 40. The anvil 26 is provided with a vertical bore 50 in which is slidably disposed the punch portion 52 of the counterpunch 30 having an axis 53. The counterpunch punch portion 52 has an end face 54. The counterpunch 30 has an enlarged body portion 56, on the bottom of which is mounted or integrally formed the punch portion 52, and the counterpunch body portion 56 has an upper end face 58 engageable by the end face 60 of the clamp 28, and a lower face 62 normally urged away, by means, for example, of a coil spring 64, from an annular abutment surface 66 on the end of a cylindrical boss 68 projecting from the surface 70 of the anvil 26, and around the periphery of which is fitted the coil spring 64.

A locating pin or plunger 72, disposed generally parallel to the punch portion 52 of the counterpunch 30, has a body portion 74, provided with a tapered end 76, slidably disposed in a vertical bore 78 formed in the anvil 26 and an enlarged head 80 having a face 82 urged against the lower surface 62 of the counterpunch body portion 56 by a coil spring 84, for example, disposed around the portion of the plunger body 74 projecting above the upper surface 70 of the anvil 26, the coil spring 84 engaging at one end the upper surface 70 of the anvil 26. This requires that the axis 53 and 39 be correctly and accurately aligned to enable the counterpunch punch portion 52 to partially project within the die cavity 36.

By means of the structure of FIG. 3, and as a result of reciprocating the punch 44 and the counterpunch 30 toward each other, the powder material 46 in the die cavity 36 is eventually compacted between the end face 54 of the punch portion 52 of the counterpunch 30 and the end face 42 of the reciprocating punch 44, inside the die cavity 36 and below the upper surface 16 of the die plate 40.

A vertical bore 86 is disposed in the die plate 40 for the purpose of providing accurate alignment of the anvil 26, and more particularly of the axis 53 of the punch portion 52 of the counterpunch 30 with the axis 39 of the bore 38 and die cavity 36. The bore 86 has preferably a beveled end 88 to facilitate introduction of the tapered end 76 of the plunger body 74 and to cause sideway displacement of the anvil 26 to allow the body 74 of the pin or plunger 72 to project into the bore 86 in the die plate 40, in the event that the bore 78 in the anvil 26 and the bore 86 in the die plate 40 are not exactly actually aligned. The length of the locating pin or plunger 72 is such that the point of its tapered end 76 is almost flush with the upper surface 16 of the die plate 40. As soon as the end face 60 of the clamp 28 engages the upper face 58 of the counterpunch 30 and begins to compress the coil spring 64, the tapered end 76 of the locating pin or plunger 72, as shown at FIG. 4, is caused to engage the bore 86 in the die plate 40 and, in the event of slight misalignment, forces the anvil 26 to slide laterally for correct alignment, the friction between the highly polished surfaces 48 of the anvil 26 and 16 of the die plate 40 being still low enough, due to the small amount of deflection of the spring 64, to permit lateral sliding to take place. At FIG. 3, the anvil 26 is shown slightly out of position such that the axis 53 of the punch portion 52 of the counterpunch 56 is not correctly aligned with the axis 39 of the die cavity 36 and the die bore 38, while at FIG. 4, as a result of the locating pin or plunger 72 having been partly introduced into the bore 86 of the die plate 40, the whole assembly consisting of the anvil 26 and the counterpunch 30 has been displaced in such manner that the critical axes 53 and 39 are now aligned preparatory to the end face 54 of the punch portion 52 of the counterpunch 30 being introduced into the die cavity 36. The powder material 46, after introduction of the end of the punch portion 52 of the counterpunch 30 into the die cavity 36, is compacted between the end face 54 of the punch portion 52 of the counterpunch 30 and the end face 42 of the punch 44 having been reciprocated towards the end face 54 of the punch portion 52 of the counterpunch 30, FIG. 5. As a result of the pressure applied by the end face 60 of the clamp 28 upon the top face 58 of the counterpunch 30, the spring 64 has been fully compressed and the lower face 62 of the counterpunch body portion 56 is in solid engagement with the annular abutment surface 66 on top of the anvil 26.

It will be readily apparent that although one locating pin or plunger 72 for fine positioning of the anvil 26 has been described and illustrated, more than one locating pin or plunger may be used. However, in arrangements wherein the work station positioner 14 is arcuately displaced over the top surface 16 of the machine table and die plate, FIGS. 1 and 2, one locating pin or plunger 72 is sufficient as the axis of the locating pin or plunger, together with the axes of the bore 78 and 86 respectively in the anvil 26 and in the die plate 40 represent one reference axis or point of location, and the axis of the drive shaft 20, FIG. 2, of the work station positioner 14 provides the second reference axis or point of location. In structures, not shown, where the work positioner is linearly displaced, two locating pins or plungers are preferable for providing accurate indexing and locating of the anvil.

The structure of FIG. 6 is identical to that of FIG. 3-5, modified however by providing a vertically disposed bore 90 in the body portion 56 of the counterpunch 30, and disposing a pin 92 in the bore 90. The pin 92 has an end 94 abutting against the upper face 82 of the locating pin or plunger 72, and another end 96 projecting above the top surface 58 of the counterpunch 30 such that when the clamp 28 is displaced downwardly the end face 96 of the pin 92 is the first to be engaged by the lower face 60 of the clamp 28. The pin 92 is thus displaced downwardly, prior to the end face 60 of the clamp 28 engaging the top face 58 of the counterpunch 30 and thus causing the spring 64 to be compressed, with the result that the tapered end 76 of the locating pin or plunger 72 is caused to project into the bore 86 in the die plate 40 and thus align the axis 53 of the punch portion 52 of the counterpunch 30 with the axis 39 of the bore 38 in the die plate 40, prior to excessive friction being developed between the engaged surfaces 48 of the anvil 26 and 16 of the die plate 40.

Figure 7:
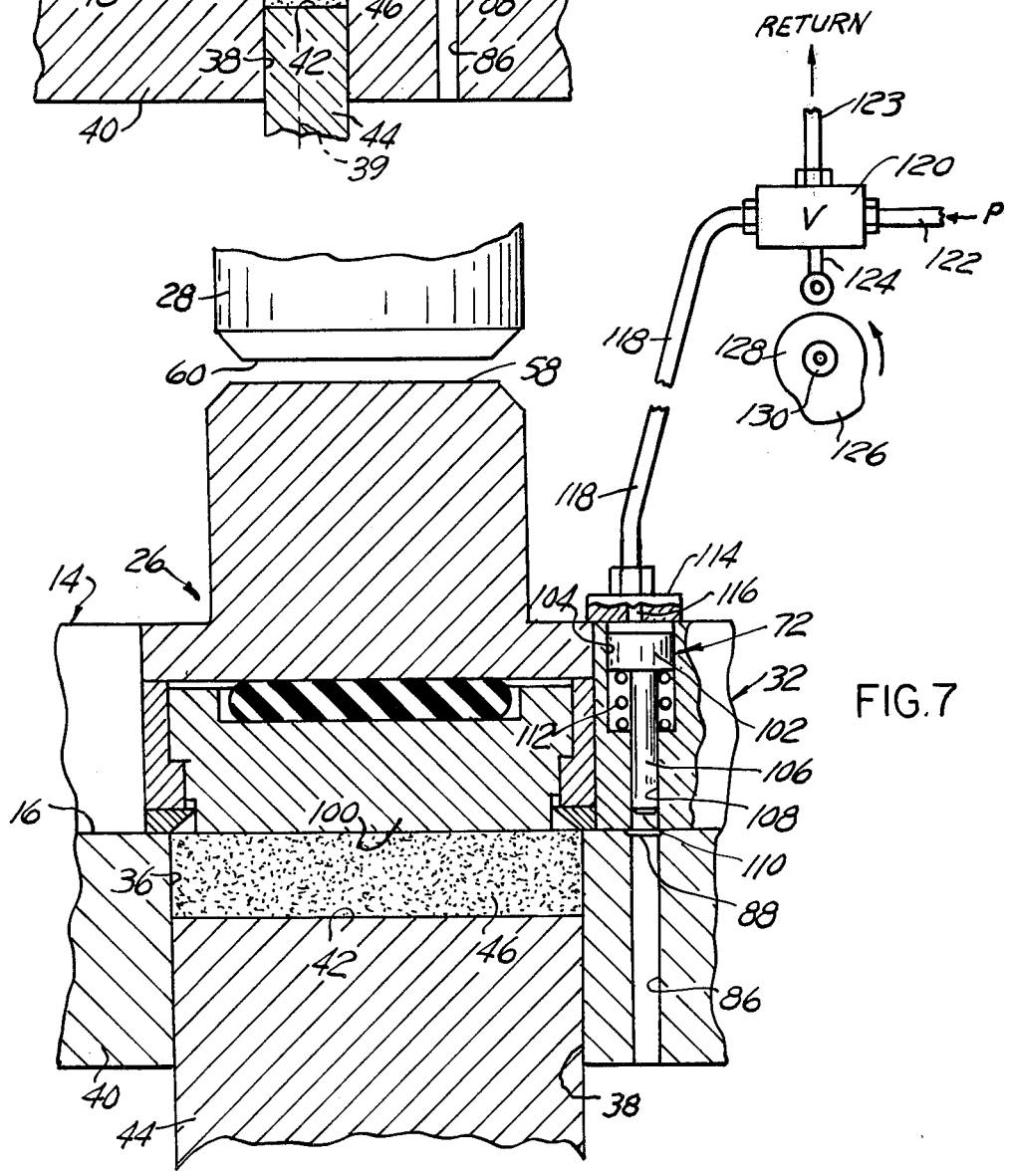
FIG. 7 is a view similar to FIG. 3, but showing a further modification thereof.

Locating and indexing means for fine positioning of the anvil, other than a mechanically actuated locating pin or plunger, are also contemplated by the present invention. For example, the locating and indexing pin or plunger may be actuated by a fluid such as hydraulic fluid or gaseous fluid, compressed air for example. Such an arrangement is illustrated at FIG. 7 wherein the anvil 26, of the type described in detail in co-pending application Ser. No. 300,577, filed on Sept. 8, 1981, provided with a retractable pad 100, is precisely located over the die cavity 36 by a fluid-actuated locating pin or plunger 72. The locating pin or plunger 72 has a piston member 102 reciprocably disposed in a cylinder 104 in the anvil 26 and a plunger portion 106, formed integral with the piston member 102 or attached thereto, slidably disposed in an aligned bore 108 in the anvil 26, the bore 108 being of reduced diameter as compared to the diameter of the cylinder 104. The plunger portion 106 has a tapered end 110 adapted to project into the indexing bore 86 in the die plate 40. A coil spring 112 is disposed in the cylinder 104 below the piston member 102 and constantly urges the piston member 102, and consequently the plunger portion 106, upwardly such that the tapered end 110 of the plunger portion 106 clears the surface 16 of the die plate 40. The cylinder 104 is closed by an end cap 114 provided with a port 116 through which pressurized fluid may be introduced into the cylinder 104 above the piston 102 via a line 118. The line 118 is connected to a three-way valve 120 capable of connecting the line 118 to a source of pressurized fluid via a pressure line 122, or to a return line 123 for exhausting fluid from the line 118. The three-way valve 120 is operated by an arm or plunger 124 controlled by the lobe 126 of a cam 128 supported by a camshaft 130. The camshaft 130 is driven by the drive mechanism of the powder compacting apparatus, not shown, and, in the position illustrated at FIG. 7, the line 118 is connected to the return line 123 through the valve 120, such that the piston member 102 and consequently the plunger portion 106 are in the position indicated, retracting the plunger portion 106 from the bore 86 in the die plate 40, due to the action of the return spring 112.

Figure 8:
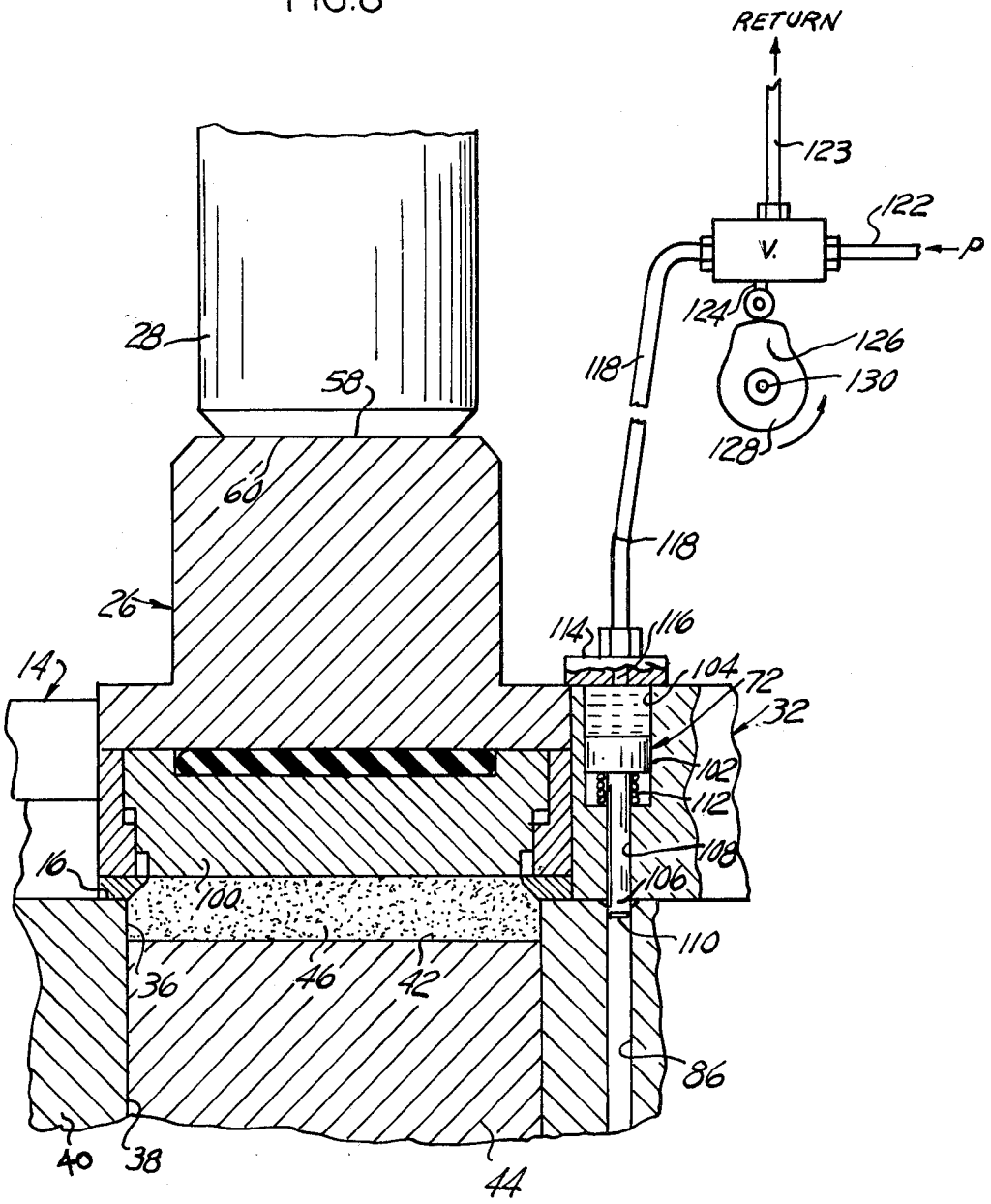
FIG. 8 is a view similar to FIG. 7 and showing a subsequent step in the operation of the mechanism of the invention.

The rotation of the camshaft 130 and cam 128 is timed relative to the actuation of the clamp 28 such that prior to the clamp 28 being operated for engaging its end face 60 with the end top surface 58 of the anvil 26, the cam 128 has rotated to the position shown at FIG. 8 causing the cam lobe 126 to engage the end of the valve lever or arm 124, thus introducing fluid, from the pressure source through the line 122 and the line 118, in the cylinder 104 above the piston member 102. The piston member 102 is thus caused to be displaced downwardly, compressing the return spring 112, and the plunger portion 106 is caused to project, at its end, into the bore 86, thus accurately locating the anvil 26 just prior to the anvil being clamped solidly in position by the clamp 28. Subsequently thereto, the punch 44 is reciprocated upwardly, such that the powder material 46 in the die cavity 36 is compacted between the face 42 of the punch and the face of the movable anvil pad 100.

Subsequently, further rotation of the cam 128 causes retraction of the plunger portion 106 from the bore 86 in the die plate 40, as a result of the pressurized fluid being exhausted from the cylinder 104 above the piston 102, and returned via the line 118 and the valve 120 to the fluid return line 123.

It will be appreciated by those skilled in the art that the locating pin or plunger 72 may be fluid operated by a double-acting piston or may be operated by other than mechanical or fluid means such as being operated by a solenoid, whose action is controlled by an appropriate switch, for example operated by a cam.

Having thus described the present invention by way of structural examples thereof, modifications whereof will be apparent to those skilled in the art, what is claimed as new is as follows:

1. A locating and positioning mechanism for a powder compacting apparatus having an anvil positionable away from a die cavity and above said die cavity for compacting powder material disposed in said die cavity against said anvil, said positioning and locating mechanism comprising a positioner effecting coarse positioning of said anvil over said die cavity and a fine positioner effecting precise positioning of said anvil over said die cavity, said fine positioner comprising a bore in said die plate, a plunger disposed in said anvil, said plunger having an end normally retracted and engageable in said bore, and means for displacing said plunger in the direction causing the end of said plunger to project into said bore.

2. The mechanism of claim 1 wherein said means for actuating said plunger comprises a clamp adapted to clamping said anvil firmly over said die cavity.

3. The mechanism of claim 2 further comprising a member normally projecting from the top of said anvil, said member being in engagement with said plunger at one end and engageable with said clamp at another end during displacement of said clamp prior to engagement of said clamp with said anvil.

4. The mechanism of claim 3 wherein said member is formed integral on the end of said plunger.

5. The mechanism of claim 3 wherein said member is a counterpunch disposed reciprocable in said anvil.

6. The mechanism of claim 1 wherein said means for actuating said plunger comprises a reciprocable piston reciprocably disposed in a cylinder, means transmitting motion of said piston to said plunger; and means for controllably introducing a fluid in said cylinder for displacing said piston.

7. A method for locating and positioning the anvil of an anvil powder compacting apparatus wherein powder material is compacted in a die cavity in a die plate against said anvil with said anvil displaceable over said die cavity, said method comprising coarse positioning said anvil over said die cavity, and fine positioning said anvil over said die cavity.

8. The method of claim 7 wherein said fine positioning is effected by displacing a plunger disposed in said anvil for projecting an end of said plunger in a locating bore disposed in the die cavity die plate.

* * * * *